US005769764A

United States Patent [19]

Tilberis

[11] Patent Number: 5,769,764

[45] Date of Patent: Jun. 23, 1998

[54] TENSION-TORSIONER EXERCISING DEVICE

[76] Inventor: Andrew Tilberis, 156 E. 82nd St., New York, N.Y. 10028-1803

[21] Appl. No.: 731,693

[22] Filed: Oct. 17, 1996

[51] Int. Cl.[6] ..... A63B 21/02

[52] U.S. Cl. ..... 482/124; 482/126

[58] Field of Search ..... 482/131, 91, 907, 482/124, 125, 10, 126, 114, 120

[56] References Cited

U.S. PATENT DOCUMENTS

| | | | |
|---|---|---|---|
| 4,335,875 | 6/1982 | Elkin | 482/131 |
| 4,456,249 | 6/1984 | Calabrese | 482/131 |
| 4,691,917 | 9/1987 | Battista | 482/131 |
| 4,911,439 | 3/1990 | Kuhl . | |
| 4,961,573 | 10/1990 | Wehrell . | |
| 4,993,705 | 2/1991 | Tolle . | |
| 5,143,057 | 9/1992 | DePasquale | 482/131 |
| 5,207,627 | 5/1993 | Doran | 482/114 |
| 5,433,688 | 7/1995 | Davies . | |
| 5,476,435 | 12/1995 | Nimmo . | |
| 5,498,218 | 3/1996 | Proctor et al. | 482/10 |
| 5,518,481 | 5/1996 | Darkwah . | |

FOREIGN PATENT DOCUMENTS

| | | |
|---|---|---|
| 434067 | 8/1935 | United Kingdom . |

*Primary Examiner*—Lynne A. Reichard

*Attorney, Agent, or Firm*—Kane, Dalsimer, Sullivan, Kurucz, Levy, Eisele and Richard, LLP

[57] ABSTRACT

An exercising device includes a non elastic strap that fits around the upper back, shoulders and upper arms of a user. The ends of the strap are coupled with a hand grip. The strap may form part of an upper torso body garment. In use, the upper torso is twisted and the handgrips pushed while tensioning upper body muscles and arms.

9 Claims, 4 Drawing Sheets

TENSION-TORSIONER EXERCISING DEVICE

BACKGROUND OF THE INVENTION

1. Field of the Invention

The present invention relates generally to an exercise device and, in particular, to an exercising device that advantageously requires the user to tense the upper body muscles only to an extent determined by the user.

2. Description of the Prior Art

The prior art discloses many forms of exercising devices for the upper torso in which elastic parts or straps require the user's arms to move away from the body against or counter to a biasing force.

In U.S. Pat. No. 5,518,481 a continuous elastic cord is adapted to be looped around a user's shoulder. Handgrips at each cord end are grasped and the upper body is exercised against the biasing resistance of the cord.

In U.S. Pat. No. 4,961,573 a boxing exercise harness is worn on the upper torso and includes handgrips, a pulley system and interposed elastic straps. The user performs a boxing routine and an elastic force provided by the straps opposes the arm movements.

In U.S. Pat. No. 5,433,688, elastic cords having a handgrip at each end are attached to a waist belt. The user's arm and upper body are moved against the resistance of the elastic cords.

In U.S. Pat. No. 5,473,435, the user wears a belt to which is attached a pair of swivel assemblies having coupled thereto counterforce units that provide an elastic biasing force for performing arm curls.

In UK Patent No. 434,067, shoulder straps extend from a belt and have coupled thereto springs having foot engaging loops for developing the muscles of the arm, chest and back.

In U.S. Pat. No. 4,911,439 an elastic cord is looped around the shoulders of a user and handles attached to the cord are grasped. The user exercises by stretching the cord.

In U.S. Pat. No. 4,993,705, an expandable strap having wrist cuffs is attached to a vest. Arm movements exert a pulling force on the strap.

Exercising devices of the foregoing types are oftentimes complicated but, more importantly, require constant expanding and contracting of the user's arms thereby causing arm weariness and the magnitude of tension is normally not dictated by the user but the parameters of the elastic member.

SUMMARY OF THE INVENTION

A principal object of the present invention is to provide an exercising device with no elastic parts so that the arms of the user do not move away from the body axis and the tension amount offered by the device is determined by the user.

Another object is to provide an exercising devise of the foregoing type which, when used, tenses the upper torso as a result of pushing on handles while twisting the upper body.

A further object is to provide an exercising device of the foregoing type which may be used during walking, running, standing or sitting.

The exercising device of the present invention benefits all upper-body muscle groups effectively and quickly. It increases tone, endurance, strength and flexibility. It is intended as an exerciser that is serious but fun to use. It provides a simultaneous work-out to accompany running, jogging or walking. Thus, can be used outdoors but indoors, as well on a treadmill. Moreover, it puts no undue strain on joints or muscles.

The exercise device of this invention balances the equation between lower body expenditure of energy with that of the upper body, by equalling a torsion or twist repetition for each step of a run, walk or jog. The normal withering of the upper body that follows serious running or walking is not only eliminated but reversed. Upper body muscle increases and serious fitness and muscle tone ensue.

These and other objects are attained by a static exercising device that advantageously employs a non elastic strap that fits around the outside of a user's upper back, shoulders and upper arm. By pushing equally with both hands against the strap with grasped handles and then a twisting motion of the upper body, pressure or load is placed on the back. This pressure is preferably spread over a large area; and, it is additionally preferred that the strap does not move or slide. Handles at each strap end when grasped by the user remain parallel and at a fixed distance from the axis of the body during the twisting motion. Thus, the user tenses the arms and upper body muscles to an extent determined by the user while twisting the upper body in a fashion simulating a boxing motion during walking, running, standing or sitting.

Other objects and advantages will become apparent from the following detailed description which is to be taken in conjunction with the accompanying drawings.

DETAILED DESCRIPTION

Figure 1:
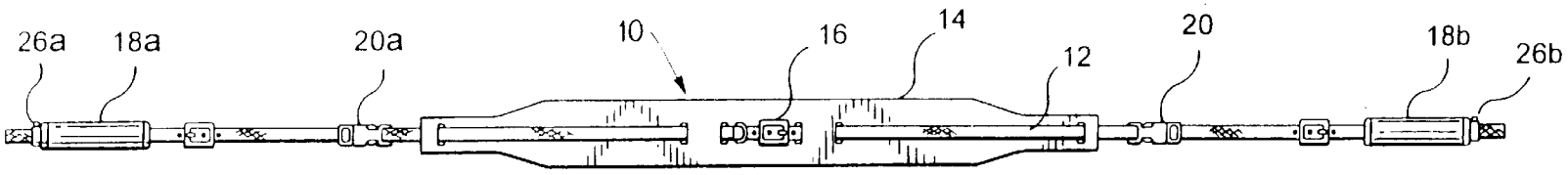
FIG. 1 is a top plan view of an embodiment of an exercising device incorporating the teachings of the present invention.
Figure 2:
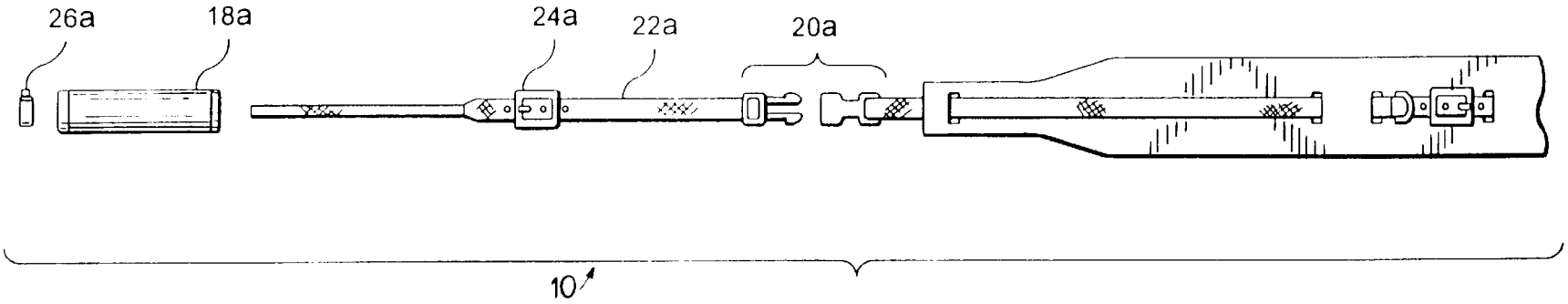
FIG. 2 is an enlarged exploded plan view of the exercising device with certain parts broken away and removed.

In the drawings, an exercising device 10 of the present invention includes a non elastic strip 12 suitably interlaced with a wider non elastic band or web 14 which is designed to fit around the upper back, shoulders, and upper arms of a user and spreads pressure and load over a larger area. The widest part of the upper skeletal structure (the outside of the humerus bone, of the upper arm and scapula of the upper back, with their incasing muscles), provides the ideal locations for the exercise device of this invention and thereby distinguishes it from the cited prior art. By holding sustained tension (contraction) of these muscle groups throughout a run or walk the exercise device of this invention helps to overcome what is believed to be a medical fact that skeletal muscle is capable of contracting rapidly and powerfully only for short periods of time. The strap 12 may be of one piece or adjustable by means of the conventional, adjustable belt buckle 16. The ends of strap 12 are detachably connected to handles or handgrips 18*a,* 18*b* by means of releasable buckles 20*a,* 20*b* of conventional construction. Between handles 18*a,* 18*b* and buckles 20*a,* 20*b* may be non elastic strap sections 22*a,* 22*b* which may be adjustable in length by the conventional belt buckle 24*a,* 24*b*. The ends of the strap sections 22*a,* 22*b* distal the buckles 20*a,* 20*b* may be releasably secured to the respective handles 18*a,* 18*b* by means of a collar and threaded bolt assemblies 26*a,* 26*b*. Obviously other known means of releasable securement and belt adjustability may be utilized.

Figure 3:
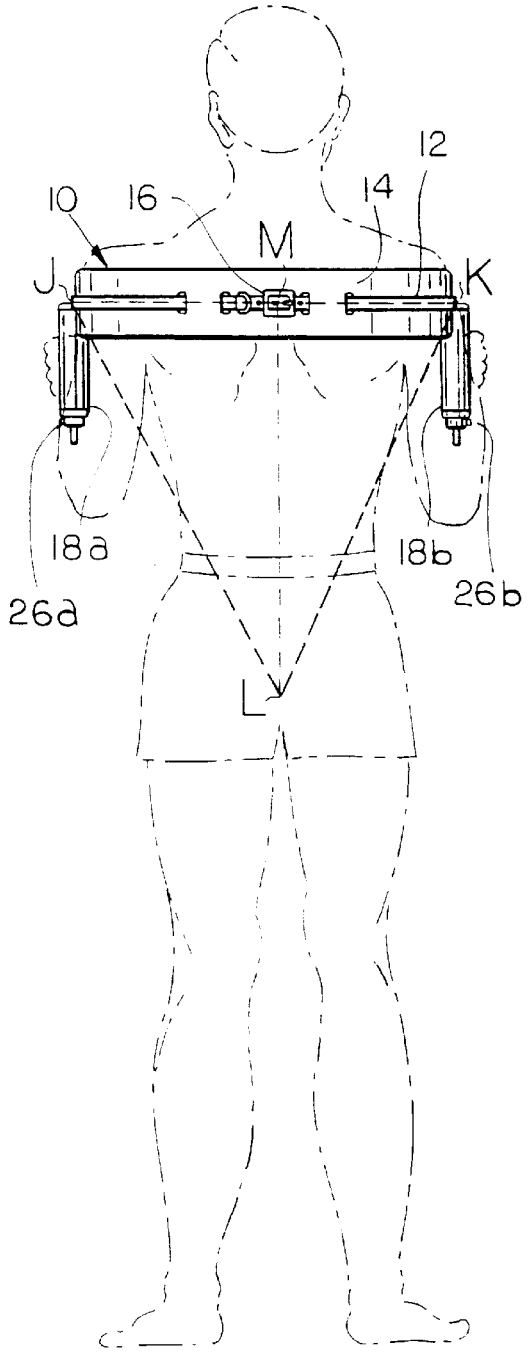
FIG. 3 is a rear view of a user, shown in phantom, with the non elastic strap of the exercise device around the upper back, shoulders, and upper arms of the user with handles grasped.
Figure 4:
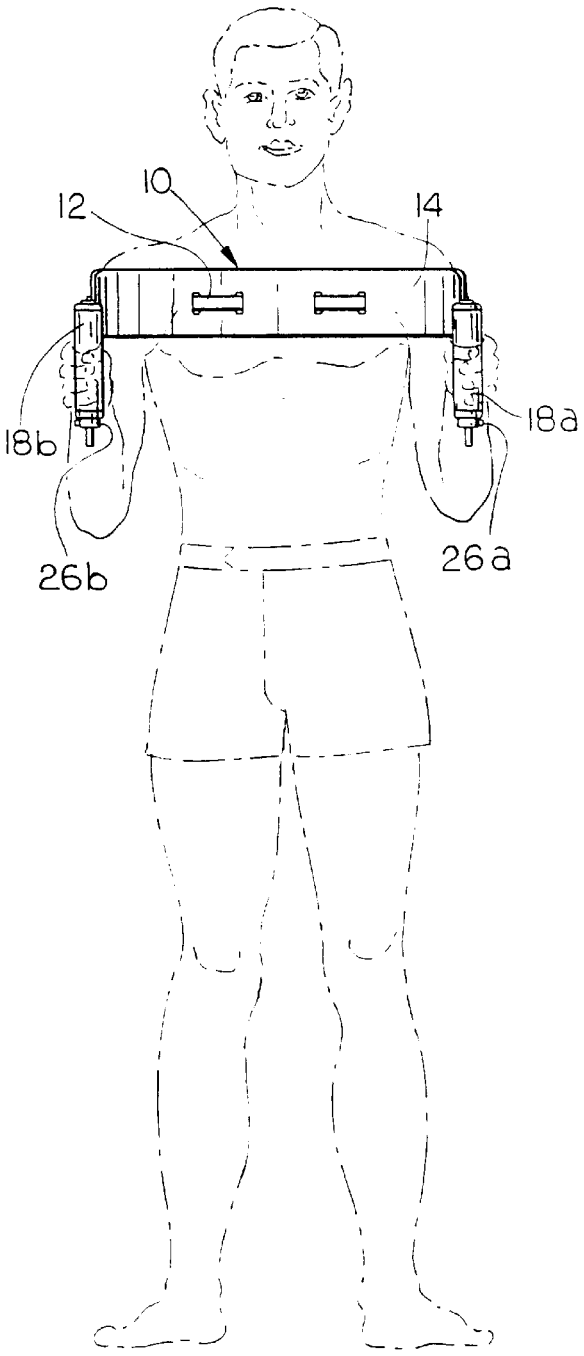
FIG. 4 is a front view of the user with the exercising device as shown in FIG. 3.
Figure 5:
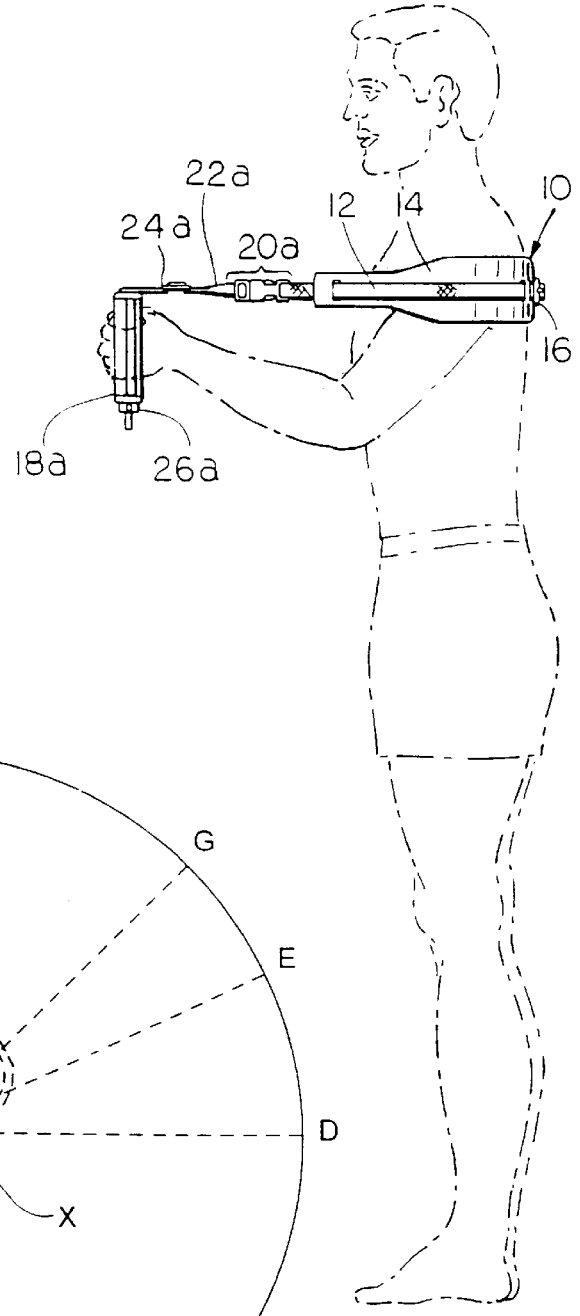
FIG. 5 is a side view of the user with the exercising device as shown in FIGS. 3 and 4.
Figure 6:
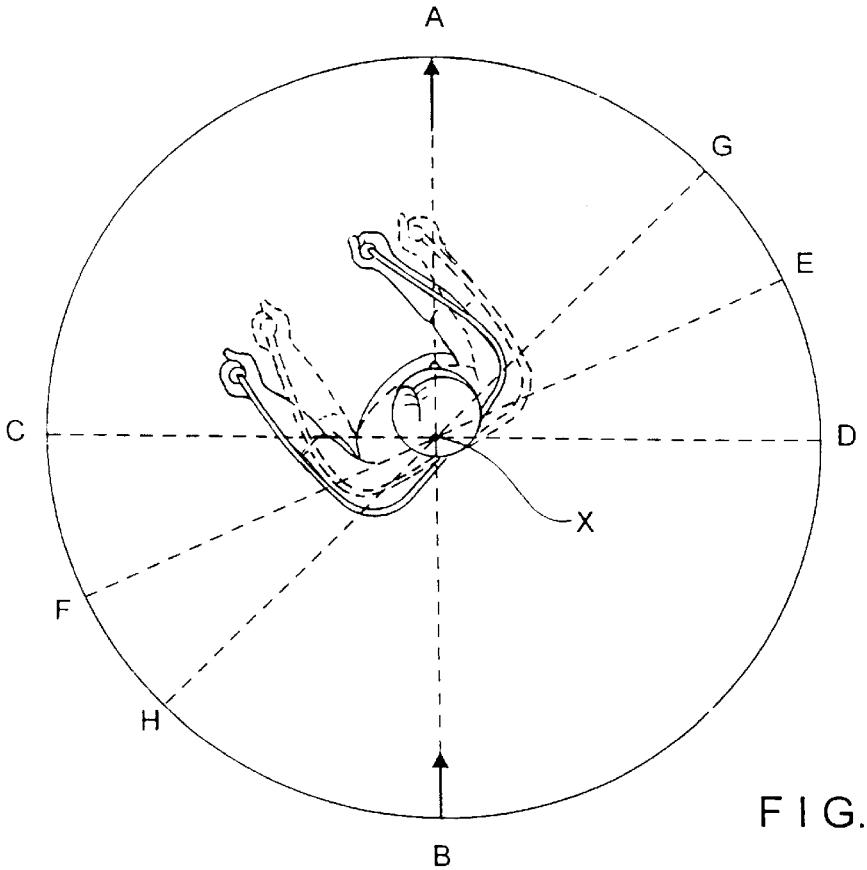
FIG. 6 is a top plan view of the user with the exercising device going through a twisting motion while tensing the muscles of the upper body.

In use, the exercising device 10 is placed around the outside of the user's back, shoulders and upper arms as shown in FIGS. 3, 4 and 5. With the handles grasped as shown the muscles of the upper body are tensed simply by pushing against the handles equally. The upper body is twisted as shown in FIG. 6. During this twisting motion, it is significant that the handles remain parallel and at a fixed distance from the axis of the body during the twisting motion. Obviously, the degree of torsion or twisting is a variable as represented by the various diameters illustrated in FIG. 6; and, this motion may take place during walking, running, standing or sitting. In this regard, A–B is the direction of travel;

E–F represents shoulder travel during normal running or walking at approximately 25° to even less movement around the body's vertical axis (x);

G–H represents increased swivel to about 45° or more;

C–D is the body at 90° or normal to the direction of travel.

With respect to G–H, the movement represents a 45° forward rotation and a 45° reverse rotation of the upper torso and arms, in unison. This is accomplished whilst forward motion is in progress through walking, jogging or running. The head and pelvis should always face in the direction of travel whilst the torso swivels through 90° for each step taken. This has the effect of a high repetition exercise for the neck and upper trapezius; the abdominals, upper and lower; the obliques; and the muscles of the lower back.

The sequence of use of the exercise device of this invention may be explained as follows. Left foot forward; shoulders and upper body "zone" twist to the left. Right foot forward; upper body "zone" twists to the right. The user is in complete control of grip, pull-tension, strength of rotation, number of twists and twist groupings. Once it becomes apparent that the body can be rotated around its own axis whilst forward motion is maintained, (the head and lower body are constantly facing in the direction of travel) then the more advanced potential can flow safely.

The twisting provides the "torsion" effect. The "tension" is provided by the exercise device itself against which resistance is obtained by its location across the upper back and the pull of both hands. The arms, pectorals, deltoids and abdominals are in tension or flexed; to a degree determined by the user and they may be held in this state throughout the run or walk or relaxed again at the dictates of the user.

Therefore, a workout is both "aerobic" and "anaerobic". It is a high "fat" burn with simultaneous muscle building properties. This makes the exercise device of this invention unique from the described prior art. It is also stress free and fun to use which makes it revolutionary. Because of the tension-torsioner's non-stress and fun aspect, it can be used by all age groups up to and including the elderly.

At JK of FIG. 3, the widest part of the upper torso, maximum torsion (twist) can be applied against the resistance of the pelvis and the lower torso. Because the triangle of the upper body JKL is pivoted on point L (lower spine) minimum force or effort is required. This gives the user a greater range of comfortable angles around the vertical or longitudinal axis of the torso.

Also JMK are the furthest points of the upper torso from the pelvis L, therefore the greatest tension (and contraction) of the upper body muscles can occur. With the exercise device of this invention in place and upper body flexed maximum leverage can be applied against the lower body, while it pursues its own activity, running, walking or jogging. Any other position from M towards L reduces the angle and therefore the effectiveness.

Figure 7:
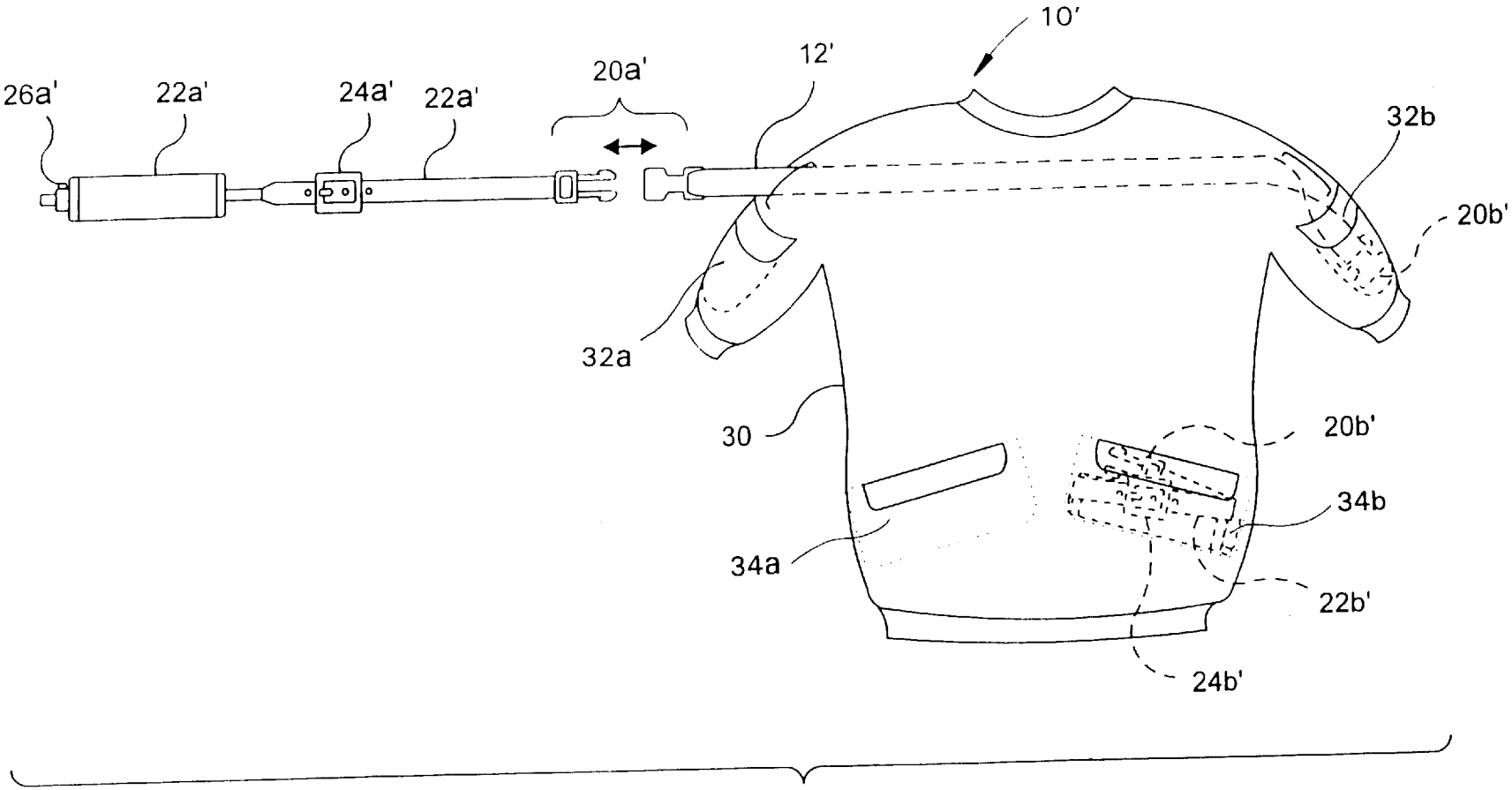
FIG. 7 is a front view of an upper body garment having attached thereto an embodiment of an exercising device of this invention with certain parts removed.

In FIG. 7, an embodiment of the inventive exercise device 10' is illustrated in which strap 12' forms part of an upper torso garment 30. Like parts are noted with an accompanying prime. Pockets 32*a*, 32*b* with closure straps or velcro strips on the sleeves may conveniently receive the female part of the buckles 20*a'* and 20*b'*. Pockets 34*a,* 34*b* with closure flaps or velcro strips on the garment front may conveniently receive strap sections 20*a'*, 22*b'* and handles 18*a',* 18*b'*. The exercise device 10' is used in the same fashion as the device of FIGS. 1–6.

The exercise device of this invention may be incorporated in a full line of sportswear (T-shirts, tank-tops, sweatshirts, track-suits, etc.). The straps and harness may be stitched and may be integral with the garment and as explained pockets/pouches internal and external can carry all attachments and accessories and the universal buckles or clip connectors.

The accessories are intended to be light so that they may be conveniently carried by the user. This will give the flexibility of breaking a run/walk for a static workout using different attachments before returning to complete one's run.

With the addition of varied and weighted handgrips and universal clip or buckle connectors one can therefore structure a more demanding workout.

Thus the several aforenoted objects and advantages are most effectively attained. Although several somewhat preferred embodiments have been disclosed and claimed herein, it should be understood that this invention is in no sense limited thereby and its scope is to be determined by that of the appended claims.

I claim:

1. The tension-torsioner exercise device comprising a non-elastic strap having opposed ends and adapted to be placed around the upper back. shoulders and upper arms of a user's body, said strap having an axis, and handles coupled to and at each of the opposed strap ends, a non-elastic strap section being interposed between each handle and the associable end of the strap, and a releasable buckle connecting the strap section with the associated end of the strap, whereby upon gripping the handles, the user tenses the upper body muscles to any extent desired and at the same time twists the upper body about the axis of the user's body while the handles remain substantially parallel to the axis of the user's body and at the same distance therefrom during the twisting of the upper body.

2. The tension-torsioner exercise device in accordance with claim 1 wherein a web of increased width is coupled with the strap to spread the pressures on the back from the exercise device over a larger area.

3. The tension-torsioner exercise device in accordance with claim 1 wherein each strap section includes adjustment means for adjusting its length.

4. The tension-torsioner exercise device in accordance with claim 1 wherein the strap includes means for adjusting its length.

5. The tension-torsioner exercise device in accordance with claim 1 wherein an upper body garment includes means for attaching thereto the exercise device.

6. The tension-torsioner exercise device in accordance with claim 5 wherein a non elastic strap section is interposed between each handle and the associable end of the strap, and a releasable buckle connects the strap section with the associated end of the strap, the garment has a pair of sleeves for the upper arms and a front, the garment including a pocket on each sleeve for receiving the associated ends of the strap and a pair of pockets or the garment front for receiving the associated handle and strap section.

7. The tension-torsioner exercise device comprising a non-elastic strap having opposed ends and adapted to be placed around the upper back, shoulders and upper arms of a user's body, said strap having an axis, and handles coupled to and at each of the opposed strap ends, a web of increased width being coupled with the strap to spread the pressures on the back from the exercise device over a larger area, a non-elastic strap section being interposed between each handle and the associable end of the strap, and a releasable buckle connecting the strap section with the associated end of the strap, each strap section including adjustment means for adjusting its length, the strap including means for adjusting its length, whereby upon gripping the handles, the user tenses the upper body muscles to any extent desired and at the same time twists the upper body about the axis of the user's body while the handles remain substantially parallel to the axis of the user's body and at the same distance therefrom during the twisting of the upper body.

8. A tension-torsioner exercise device comprising a strap having opposed ends and adapted to be placed around the upper back, shoulders and upper arms of a user's body, said strap having an axis, handles coupled to and at each of the opposed strap ends, whereby upon gripping the handles, the user tenses the upper body muscles to any extent desired and at the same time twists the upper body about the axis of the user's body while the handles remain substantially parallel to the axis of the user's body and at the same distance therefrom during the twisting of the upper body, an upper body garment including means for attaching thereto the exercise device, a strap section being interposed between each handle and the associable end of the strap, and a releasable buckle connecting the strap section with the associated end of the strap, the garment having a pair of sleeves for the upper arms and a front, the garment including a pocket on each sleeve for receiving the associated ends of the strap and a pair of pockets or the garment front for receiving the associated handle and strap section.

9. A tension-torsioner exercise device comprising a strap having opposed ends and adapted to be placed around the upper back, shoulders and upper arms of a user's body, said strap having an axis, handles coupled to and at each of the opposed strap ends, whereby upon gripping the handles, the user tenses the upper body muscles to any extent desired and at the same time twists the upper body about the axis of the user's body while the handles remain substantially parallel to the axis of the user's body and at the same distance therefrom during the twisting of the upper body, a web of increased width relative to the strap being coupled with the strap to spread the pressures on the back from the exercise device over a larger area of the back, a strap section being interposed between each handle and the associable end of the strap, and a releasable buckle connecting the strap section with the associated end of the strap, each strap section including adjustment means for adjusting its length, the strap including means for adjusting its length.

* * * * *